United States Patent [19]

Furutsu

[11] Patent Number: 4,499,928

[45] Date of Patent: Feb. 19, 1985

[54] CABLE BANDING MACHINE

[75] Inventor: Akira Furutsu, Tokyo, Japan

[73] Assignees: Japan Bano'k Co. Ltd., Tokyo, Japan; Ben Clements & Sons, Inc., South Hackensack, N.J.

[21] Appl. No.: 593,994

[22] Filed: Mar. 27, 1984

[30] Foreign Application Priority Data

Apr. 6, 1983 [JP] Japan ..... 58-59316

[51] Int. Cl.[3] ..... B21F 9/02; B21F 45/00; B29C 17/00

[52] U.S. Cl. ..... 140/93.2; 140/123.6; 156/443; 156/468; 156/475; 156/481

[58] Field of Search ..... 156/443, 468, 475, 486, 156/579, 184, 187, 199, 274.4, 275.1, 477.1, 478, 481.2, 492; 100/27; 140/57, 93 A, 93.2, 123.6

[56] References Cited

U.S. PATENT DOCUMENTS

| | | | |
|---|---|---|---|
| 3,589,406 | 6/1971 | Moberg | 140/123.6 |
| 3,830,263 | 8/1974 | Benfer | 140/123.6 |
| 4,178,973 | 12/1979 | Collier et al. | 140/93.2 |
| 4,359,070 | 11/1982 | Hydassy et al. | 140/123.6 |
| 4,368,762 | 1/1983 | Peterpaul | 140/93 A |
| 4,371,010 | 2/1983 | Hydassy | 140/123.6 |
| 4,371,011 | 2/1983 | Hydassy | 140/123.6 |

*Primary Examiner*—Edward Kimlin
*Assistant Examiner*—Merrell C. Cashion
*Attorney, Agent, or Firm*—Blum, Kaplan, Friedman, Silberman & Beran

[57] ABSTRACT

Disclosed is a machine for automatically banding particularly linear objects in groups with strap-type banding elements having interlockable male and female members at one and the other ends thereof respectively, which comprises a pistol-shaped machine body and an operation lever provided to a grip handle thereof and with which, when the operation lever is triggered, each banding element loaded on the machine body is fed forwardly in the machine body, applied about a group of objects to be banded and received on a front end portion of the machine body and then fastened with its male and female members interlocked to accomplish banding, the machine being characterized by comprising a pusher member driven through triggering of the operation lever to move in a guide path in the machine body from a rear end portion to a front end portion of the machine body while pushing a banding element, a stopper for fixing an end portion of the banding element at a front end portion in the guide groove during a banding operation, and a pusher lever pivotally supported at a front end portion of the pusher member and having a bending face along its front edge which is adapted to bring to be interlocked the male and the female members of the banding element after the movement of the element is stopped by the stopper.

9 Claims, 21 Drawing Figures

CABLE BANDING MACHINE

BACKGROUND OF THE INVENTION

The present invention relates to a cable banding machine for automatically banding into the form of a bundle a plurality of various objects, particularly linear bodies such as cables, wires and the like, with use of plastic-made strap-type banding elements capable of being double-folded and being self-lockable. With this machine, bundling of for example cables can be worked simply through a single triggering operation to be made of an operation lever of the machine.

For purposes of for example orderly grouping a number of cables or cords run in various directions in electrical appliances and securing open spaces for disposing parts therein or for facilitating assembly operations at safety, there have already been developed and put into practical uses a variety of band-type banding elements or devices made of a synthetic resin such as nylon in particular. Generally, the known banding devices comprise an annular socket part and a band or belt part continuously extended from the socket part. On one side face, the belt part is formed with a series of teeth resembling saw-teeth in section, and the socket part is provided in the opening thereof with a rockable claw member having at least one teeth also resembling a saw-tooth in section.

In use of the element, the belt part wound in a loop form about a group of objects to be bundled is applied into the socket part, and banding with the element is made through a locking engagement between the teeth on the belt part and the tooth or teeth on the claw member in the socket part. These banding elements have the advantage that depending on the length of their belt part, they can bundle a wide range of the number of objects or linear bodies to be bundled.

Inconveniently, however, banding with the elements requires to be manually operated to apply the belt part about the group of objects to be bundled, insert the leading end or free end of the belt part through the socket, and then tighten the belt part to a desired tension condition by a banding machine, followed by cutting away an excess length portion of the belt part. These required manual operations are highly troublesome and are to be automated, desirably.

Also, in actuality the number of linear objects to be banded into a unitary group arrangement is not widely varied and in practice a large length portion of the belt part is cut away as an excess portion and simply discarded as waste. Obviously this is disadvantageous, but it is indispensable that the element has an excess length portion, which is necessary for operating the insertion of the belt part into the socket part and operating the banding machine, even though it is to be discarded as above. Normally, the length of the excess portion in reference is so great as to be 50 to 80% of the length of the element, and this means a great disadvantage economically.

There have also been proposed such strap-type banding elements which comprise a belt- or sheet-like device made of a synthetic resin and having mutually locking members, for example engageable male and female members, at ends thereof and a bending or folding part at the center of the length thereof, and which in use is double-folded with cables or the like held between the double-folded segments thereof. However, these banding elements have not widely been utilized, inconveniently due to the fact that there has not yet been developed an element dispensing machine which is simple in structure and easy to operate and can fasten the elements.

SUMMARY OF THE INVENTION

Therefore, a primary object of the present invention is to provide a cable banding machine which can automatically dispense and fasten strap-type cable banding elements made of a synthetic resin and capable of being double folded to hold cables, cords or the like between the folded-over segments thereof.

It also is an object of the invention to provide a cable banding machine with which banding or bundling with the strap-type banding elements can be accomplished through a single triggering operation of an operation lever thereof.

To attain such and other objects, the invention provides a cable banding machine essentially characterized by comprising a machine body formed with a guide path, an operation lever or trigger privotally movable in an opening in the body, a pusher member which, when the operation lever is pulled, undergoes slidable motion in the guide path from a rear side to a front side of the body, while pushing the banding element, a movable or stationary stopper disposed below a front end portion of the guide path, a pushing and bending lever pivotally supported at a front end portion of the pusher member, and when the banding element is held immovable by the stopper, being rotated to double-fold the banding element by a folding or bending face thereof and bring to interlock the engageable ends of the banding element.

The above and other objects, features and advantages of the present invention will become more apparent from considering the following description of the preferred embodiments taken in conjunction with the accompaying drawings.

BRIEF DESCRIPTION OF THE DRAWINGS

FIGS. 8 (B) to 8 (D) are respectively a plan view and in combination show the manner in which a banding-element assembly loaded in the machine is fed into and guided in the machine body;

THE PREFERRED EMBODIMENTS

Figure 1:
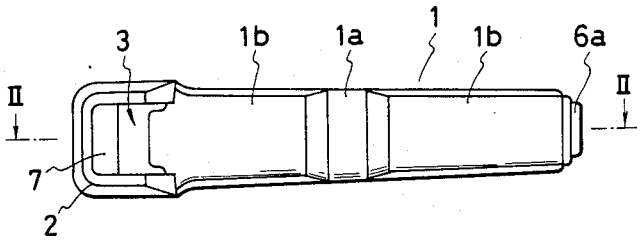
FIG. 1 is a plan view of a banding element for use in or by the banding machine according to the invention.
Figure 2:
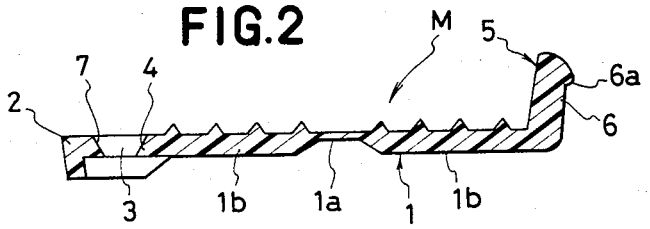
FIG. 2 is a sectional view taken along line II—II in FIG. 1.
Figure 3:
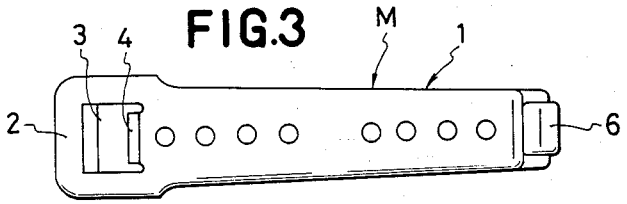
FIG. 3 is a bottom plan of the banding element.

Now, in order to facilitate a fuller understanding of the present invention, a brief explanation will initially be given the strap-type banding elements which the machine according to the invention dispenses and with which the machine bands or otherwise fastens a variety of goods to one body bundle forms.

To this end, reference may be had to FIGS. 1 to 4 of the accompanying drawings, which show structural details of the strap-type banding element. As illustrated, the banding element indicated at the letter M is a one-body device molded from a synthetic resin and consists of a strap body 1 comprising a central reduced thickness part 1*a* and, on its sides, thicker parts 1*b* and 1*b*, one of which has at its end a female member or a ring part 2 having an aperture 3 formed with a bearing flange 4, while the other having a male member or head 5 which is lockably engageable in the aperture 3. As best seen from FIG. 2, the head 5 comprises a projection 6 projecting in an L shape from the thicker part 1*b*. When the element M is dispensed by the banding machine of the invention, the projection 6 is inserted into the aperture 3 of the ring part 2, and its hook part shown at 6*a* is engaged with an edge wall portion 7 of the aperture 3.

Figure 4:
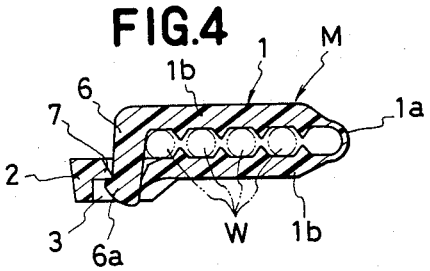
FIG. 4 is a sectional view, showing an operation condition in which a group of cables or the like is banded in a bundle by a banding element, which is in a fastened final condition.

In the final condition in use of the element M shown in FIG. 4, the strap body 1 is double folded with the reduced thickness part 1*a* as the point of folding, in a manner of holding linear objects, for example cables or wires, W, between the two thicker parts 1*b* and 1*b*, and the hook part 6*a* of the projection 6 inserted into the aperture 3 is with its hook part 6*a* in engagement with the edge portion 7.

With the element M, a number of the same are molded from a synthetic resin into an integral assembly M' in which individual elements M are connected in a plane through filament-like necks (FIG. 8), and in use, the elements are loaded in the banding machine assembly by assembly and individually severed in the machine and then applied to bundle objects or otherwise tie a portion of the opening of a bag-like object in a manner as above described with reference to FIG. 4.

With the machine or apparatus according to the present invention, the bundling or banding operation can be done simply through a single triggering operation made of a single operation lever, by which the element M is double folded, and with objects to be banded securely held between the two folded segments of the strap body, the hook part is brought into engagement with the wall edge portion in the aperture.

A detailed description will now be entered into the banding apparatus of the invention, and initially into structural features of essential parts thereof.

Figure 5:
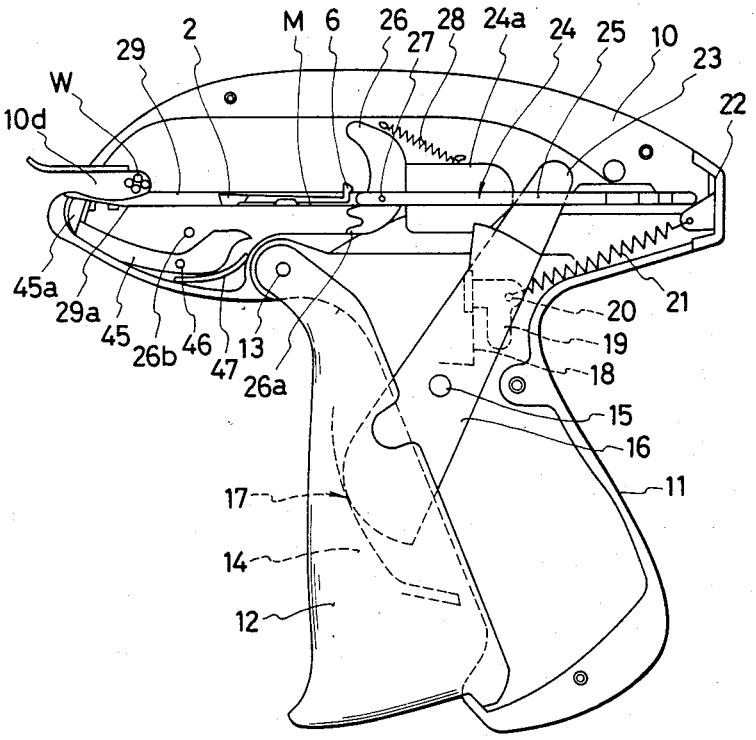
FIG. 5 shows a sectional view of essential parts of a banding machine according to a first embodiment of the invention, the machine being in a condition ready for a banding operation.
Figure 6:
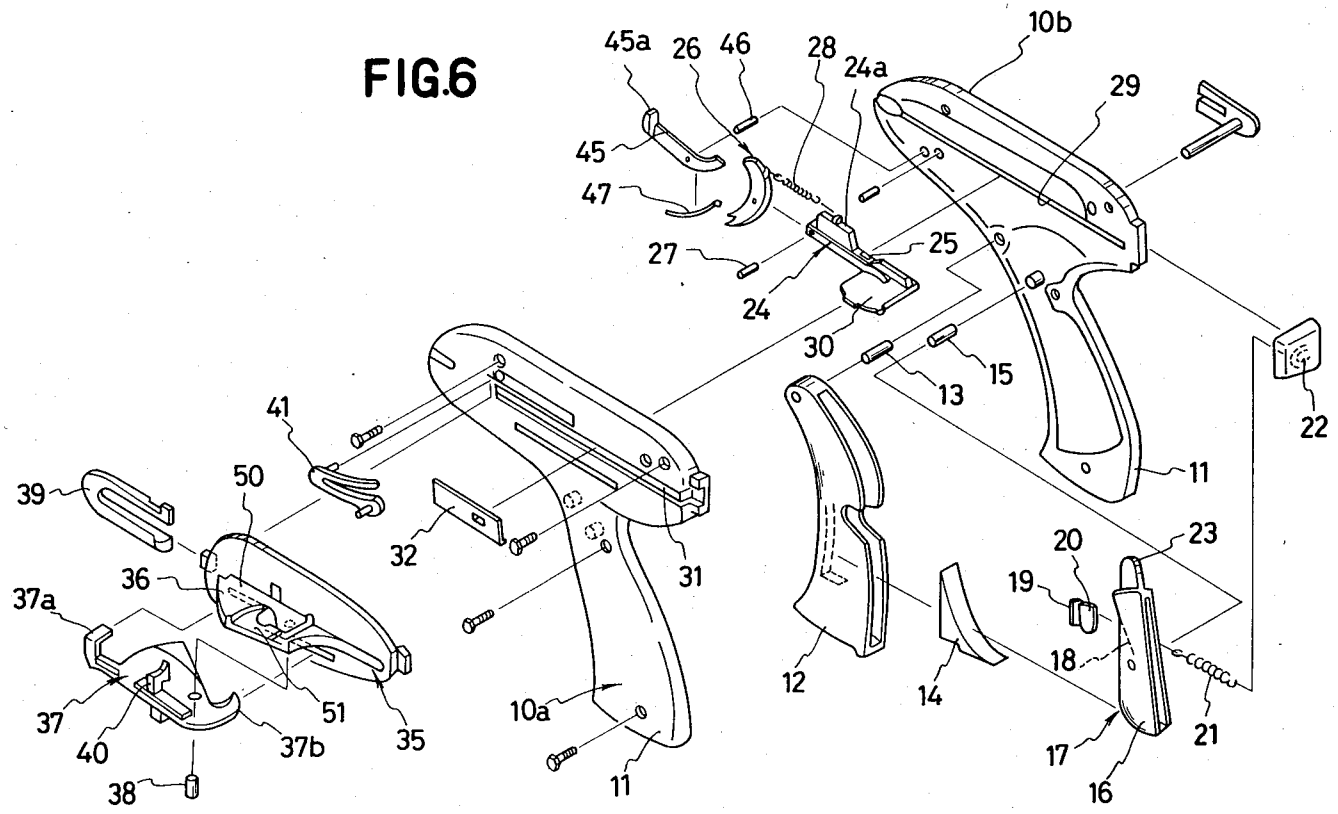
FIG. 6 is a break-up view, showing essential parts of the machine of FIG. 5.
Figure 7:
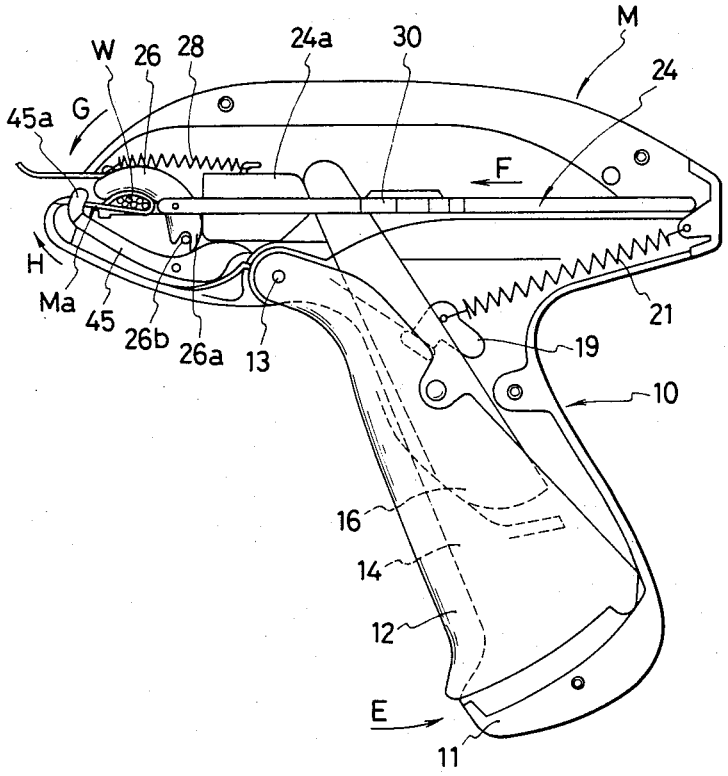
FIG. 7 is a sectional view similar to that shown in FIG. 5, showing the machine in a final operation condition in which it has accomplished a banding operation.

FIGS. 5 to 7 in combination represent a first embodiment of the invention, in which FIG. 5 is a sectional view, showing essential parts of the apparatus according to this embodiment, FIG. 6 representing a breakdown view of the apparatus, and FIG. 7 showing the same apparatus but in a different operation condition in comparison to FIG. 5.

The machine according to the invention as a whole takes a configuration generally resembling a pistol, and in operation, an operation lever resembling a trigger in a pistol may be pulled or gripped in by a single hand. As this operation is repeated, the machine feeds individual elements of an assembly loaded on the machine, intermittently element by element from one side thereof, and in so feeding the element assembly, severs individual elements successively and moves them by a pusher member toward the front or nose end thereof. In a front end portion, the machine has an opening, in which it receives objects to be banded or bundled, and in such end portion, it functions to place a first end portion of the element beneath the objects to be banded or bundled, turn a second half portion over the objects, and finally bring the engageable ends of the element into lockable engagement.

Thus, by or with the apparatus of the invention, banding elements are fed, moved and applied in the following manner: They are loaded on the machine in the form of an integral assembly. A first located one of the plurality of elements of the loaded assembly is severed and fed into a guide groove. As the pusher member is then driven, the first severed element is moved in the guide groove into the path of motion of the pusher member, and as the pusher member is further driven, its first half portion becomes pushed into a position below objects to be bundled which have preparatively been placed in the front end opening of the apparatus. Further, when the pusher member is further advanced, a second half portion of the element is turned by the function of a bending or folding lever provided at a front end portion of the pusher member, over the objects to be bundled or tied, and the engageable male and female members of the element are then brought into a locking engagement to accomplish the intended banding or bundling operation.

Whereas further details of the motion of banding elements will later be described with reference to FIGS. 8 (A) to 8 (D), in the plan views of these Figures, the elements are moved in a zigzag path.

In greater detail, the banding machine of the invention has the following structural and operational features.

The machine consists of a pistol-type machine body 10, which comprises integrally assembled left member 10*a* and right member 10*b* (FIG. 6), including a handle 11 having an opening in its front side wall. An operation lever or trigger 12 is pivotally supported by a shaft 13 so that it can be pivotally pulled or gripped into the opening in the handle 11 with the shaft 13 as the fulcrum of the motion. As shown in FIG. 6, the operation lever 12 has a U-letter shape in section, and it receives a cam 14 therein, which has a triangular shape in side elevation.

The handle 11 houses in a central portion thereof a lever 16, which is pivotally supported by a shaft 15 and is in contact with the triangular cam 14 at its lower end face 17 so that it can operate a pivotal motion in association with the operation lever 12.

The lever 16 is so structured as to generally comprise two plate members joined together with an interspace. On a guide face 18 formed on the plate member facing the operation lever 12, a bracket 19 is slidably engaged, which has a hole 20, in which one end of a return spring 21 is securely held, the other end of the spring 21 being secured to a cap member 22 fitted in a hole provided at the rear end of the machine body or body member 10. When the operation lever 12 is operated by gripping at it to cause the lever 16 to rotate, the bracket 19 moves toward up on the guide face 18, and in accordance with such motion of the bracket 19, the return spring 21 changes in its position so as to maintain its spring force substantially constant throughout the operation stages of the lever 12.

The upper end portion indicated at 23 of the lever 16 is disposed through a groove 25 of a pusher member 24, and accompanying to forward and backward motion of the operation lever 12, such upper end portion 23 of the lever 16 undergoes backward and forward motion in the groove 25.

The pusher member 24 is a member constituting a source of drive as it were for all machine members hereinafter to be described, and it either directly or indirectly causes the banding elements M to be pushed and double folded. At its front end portion, this pusher member 24 carries a bending or folding lever 26, which is pivotally supported by a pin 27, and an upper end portion of this folding member 26 is connected by a return spring 28 to an abutting member 24*a* provided in a front part of the pusher member 24 so that the bending member 26 is normally kept in its stand-up position, which is the position shown in FIG. 5.

In a front or nose end portion of the main body or body member 10, an element stopper 45 is also pivotally supported by a pin 46, below the path in which the pusher member 24 is moved in forward and backward directions. At its rear end portion, the stopper 45 is acted upon by a return spring 47 in the form of a leaf spring so that except for the time of operation for putting the male and female members of the element into engagement, it can be maintained in a non-operative position or condition.

The above-mentioned pusher member 24, which is adapted to slide in a guide groove or path 29 provided inside the body members 10*a* and 10*b*, has a laterally extended portion 30, which is projected through a slot 31 formed in the left-side body member 10*a* and, in that projected condition, driven to move in forward and backward directions (toward left and right directions in for example FIGS. 5 and 7). The extended portion 30 has at its outer end a vertically projected member, in which a plate cutter blade 32 is fitted, and an arrangement is made such that at a certain point of the motion of the pusher member 24, the cutter blade 32 functions to sever a single banding element M at a time from the assembly M'.

As shown in detail in FIG. 6, on the outer side of the left body member 10*a*, there is provided a supply part 35 for the elements M, which comprises a vertical body portion and a guide portion 36 horizontally perpendicularly mounted to the former. Below the guide portion 36, further, an element support member 37 is pivotally mounted by a pin 38 in a manner of being operatively associated with the pusher member 24.

As before stated, the upper end portion 23 of lever 16 is disposed through the groove (or slot) 25 of the pusher lever 24, and as the lever 16 oscillates, the pusher member 24 is oscillated. The lever 16, of which the upper end portion 23 slidably bears against a side face of the element support member 37, functions to push the support member 37 away the machine body 10 and, in contact with a hook portion 37*b*, push it toward the body 10.

At the front side of the guide portion 36 horizontally projected from the body portion of the element supply part 35, there is a substantially U-shaped release lever 39 disposed in a manner of holding the guide portion 36 between its horizontally extending legs. When forwardly displaced, this release lever 39 functions to downwardly drive a feed claw member 40 vertically movably mounted to the element support member 37 and release the engagement of the claw member 40 with the assembly M' of elements M.

Also in FIG. 6, the reference character 41 denotes a projection member having a protuberant capable of being protruded in the supply path of element M, and in the protruded condition, it functions as a stopper to inhibit a backward motion of the element M sent into the guide groove 29. Also, this projection member 41 is acted upon by the above-mentioned release lever 39 so as to be disengaged from the element M. Thus, by operating the release lever 39, the assembly M' of elements M once charged in the machine can be taken out of the machine for example upon completion of a necessary number of the banding operation. It will be noted that in this case a single element M is left present in the apparatus ready for being dispensed [FIG. 8 (B)], so that a next tying or banding operation can immediately take place.

Figure 8:
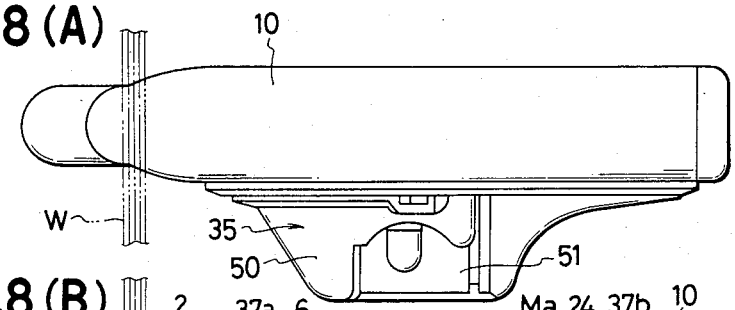
FIG. 8 (A) is a plan view of the machine of the first embodiment of the invention.
Figure 8:
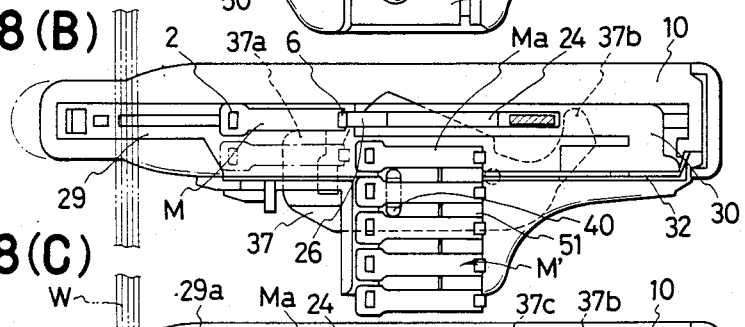
Figure 8:
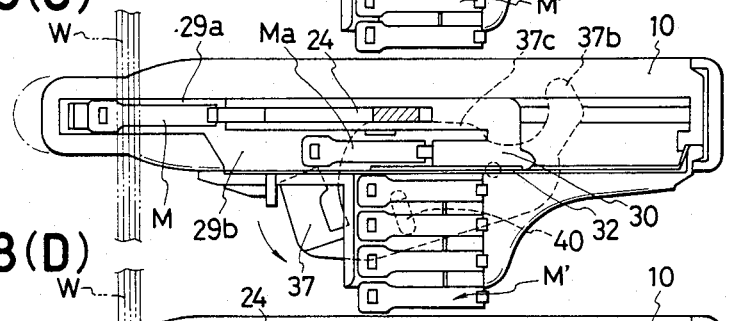
Figure 8:
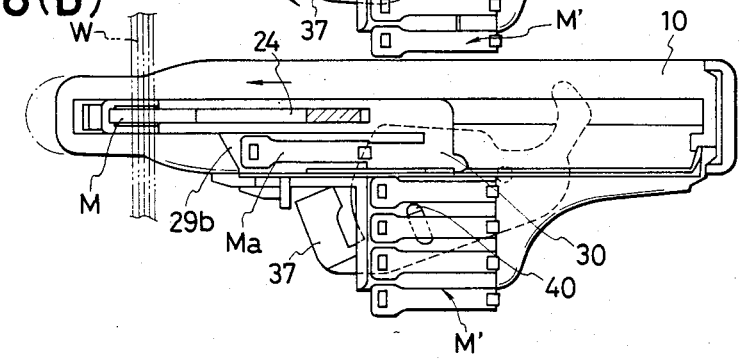

Now, with reference mainly to FIGS. 8 (A) to 8 (D), a detailed explanation will next be entered on the operational features of the apparatus of the invention.

(A) Charging of Element Assembly:

FIG. 8 (A) shows a schematic plan view of the banding apparatus or machine of the invention, in which it will be seen that the element supply part 35 is provided at a side (the left-hand side) of the machine body 10. The supply part 35 is formed with a guide surface 51, which is covered with a lid member 50. The assembly M' of elements M is charged in the open space between the lid member 50 and the guide surface 51.

FIG. 8 (B) shows, with the lid member 50 removed away, the condition in which an element assembly M' has been placed on the guide surface 51. As before stated, from the preceding operation, a single element M is left present in the guide groove 29 so as to be used for banding objects if the operation lever is operated in this condition. This condition is also seen in FIG. 5, in which at the front end of the pusher member 24 the bending lever 26 is biased by the return spring 28 and is in its stand-up position, its rear end face being born by the abutting member 24*a*. The bending lever 26 is located immediately behind the element M.

Also as shown in FIG. 8 (B), the element M is in the machine with its ring part 2 disposed in the front or its projection 6 in the rear. Further, a feeder member 37*a* provided at the front end of the element M, and the bending lever 26 is in abutment with its front curved face against the rear end of the projection 6 of the element M, while it is born with its rear end face by the abutment member 24*a* as before stated.

Further in the condition shown in FIG. 8 (B), the element M is so restricted as not to come out of the prescribed position in the guide groove 29. This is made as a result of the feeder member 37*a* being placed in contact with a side face of the element M as a result of the element support member 37 having been rotated so as to have its front end located closer to the machine body 10 with the rear end of the pusher member 24 in abutment against the hook member 37*b* of the support member 37. Also, the feed claw member 40 is protruded in the gap between two adjacent elements M and M so that feeding-in of a next element M can effectively take place.

(B) Feed-In of Elements:

In the condition shown in FIG. 5 in which the operation lever 12 is in a free condition and the pusher member 24 is in its retracted position, a hook 45*a* provided at the front end of the stopper 45, which can be protruded into the guide groove 29 by the function of the return spring 47 comprising a leaf spring, is maintained below the bottom face 29*a* of the guide groove 29. (The stopper 45 is a member for maintaining the element M immovably in position during winding of the element about an object or objects to be banded.) FIG. 5 also shows that in this condition, objects to be banded, for example cables or wires W, are received in the opening indicated at 10*d*, provided at a nose end portion of the machine body 10.

Then, FIG. 8 (C) shows the condition in which an element M which has already been sent in the machine close to the front end thereof is now partly inserted in a position below the cables W. That is to say, the element M has been moved by the pusher member 24 to reach the condition in which a first half portion thereof is now located below cables W.

As the pusher member 24 is driven forwardly, that is, toward the nose of the machine in the above, the top end portion 23 of the lever 16 presses against the side end face indicated at 37*c* of the element support member 37, which therefore undergoes a rotation as shown by an arrow in FIG. 8 (C) to bring the side end face 37*c* into a horizontal position as shown. At the same time as this, the cutter blade 32 is also driven forwardly to sever by cutting the element Ma that has been located, in the operation condition of FIG. 8 (B), deepest into the apparatus among all member elements of the loaded assembly M', and the severed element Ma is driven on the guide surface indicated at 29*b* as pressed by the laterally extended portion 30 of the pusher member 24. (It will be seen that in the condition shown in FIG. 8 (C), the element Ma has already been moved a more or less distance on the guide surface 29*b*.)

(C) Tying or Bundling Operation:

As the operation lever 12 is further deeply pulled into the handle 11, the condition shown in FIG. 8 (C) becomes changed into that shown in FIGS. 7 and 8 (D).

In this condition, the pusher member 24 has changed its position from the one shown in FIG. 8 (C) to the one shown in FIG. 8 (D) in the direction as shown by an arrow in FIG. 8 (D), and while the element M is now in the condition of completely bundling cables W (FIG. 4), the element next to be fastened is brought at the front end point on the guide face 29*b*.

With reference to FIG. 7, as the operation lever 12 may be gripped or pulled in as shown by an arrow E, the lever 16 in abutment against the cam 14 housed in the operation lever 12 undergoes a pivotal motion in the direction also of the arrow E and the pressure member 24 in contact engagement with the upper end portion 23 of the lever 16 is moved forwardly in the direction shown by an arrow F.

At a first stage of the operation, the bending or folding lever 26 born by the abutting member 24*a* of the pusher 24 is in its initial position shown in FIG. 5. As the pusher member 24 is then moved an initial portion of its possible replacement, the underside face of the abutment member 24*a* becomes in contact with the stopper 45, which is therefore rotated in the direction of an arrow H in FIG. 7 to bring the hook 45*a* to its raised position protruding above the guide face 29*a* of the guide groove 29. In its raised position, the hook 45*a* catches at the ring part 2 of the element M(Ma) and thereby prevents the element from being further advanced.

Then, the pusher member 24 may be driven for a further portion of its possible motion by a continued amount of operation of the lever 12, when the bending lever 26 becomes caught with its lower fork portion 26*a* by a pin 26*b* set between. the two body members 10*a* and 10*b* so that the lever 26 is pivotally moved in the direction shown by an arrow G, whereby the element M(Ma) supported on the guide surface 29*a* can be bent or double folded and fastened as shown in FIGS. 4 and 7.

Upon completion of the fastening of the element and accordingly of the tying or banding operation, the gripping at the operation lever 12 may be released, when the condition shown in FIG. 5 may be restored. As the pusher member 24 returns to its position shown in FIG. 8 (B), the element support member 37 is rotated in the clock-wise direction in the same FIG. 8 (B) and the feeder member 37*a* at the front end of the support member 37 functions to send the element Ma located on the guide surface 29*b* in FIG. 8 (D) to the position of the element M in FIG. 8 (B). At the same time, that is, as a result of rotation as above of the element support member 37, the element assembly M' is fed by the distance corresponding to the inter-element pitch onto the guide surface 29*b* by the function of the feed claw member 40.

(D) Removal of Element Assembly:

Upon completion or interruption of the banding operation, it may occur that it is necessary to remove any unused elements of the loaded element-assembly out of the machine, and in that event, the U-shaped release lever 39 may be pressed toward the nose end of the apparatus by a finger, whereby the projection member 41 will be moved toward up so as to be out of operation and also the feed claw member 40 mounted to the element support member 37 will be lowered below the guide surface 29*a*. Now that no longer operative are the projection member 41 which in operation will prevent the element assembly M' from being moved in the backward direction, namely in the opposite direction to that in which it was fed and the feed claw member 40 which in operation will feed the assembly M', it can be operated with ease to pull the unused portion of the element-assembly M' out of the machine.

The above described tying apparatus according to a first preferred embodiment of the present invention is characterized most essentially in that as best seen from FIGS. 6 and 7, the apparatus includes the stopper 45 disposed in a nose end portion of the machine body 10 in a manner capable of being retractably projected above the guide surface 29*a* of the guide groove 29 and also the bending or folding lever 26 pivotally mounted to the pusher member 24.

At the terminal point of its forward motion in accordance with the motion of the pusher member 24, the folding lever 26 becomes engaged at its lower end portion by the pin 26*b* and then undergoes a pivotal motion to change its position from the one shown in FIG. 5 to that shown in FIG. 7, turning a second half portion of the element M(Ma) over objects to be banded or bundled.

With the stopper 45, then, this functions to maintain in position each element M delivered to that position so that fastening of the element M can without fail take place, while upon completion of the fastening of the element M, namely the banding operation, it can return to its normal position below the guide surface 29*a* so that tied or bundled objects such as cables or the like W can with ease be taken out of the machine.

Figure 9:
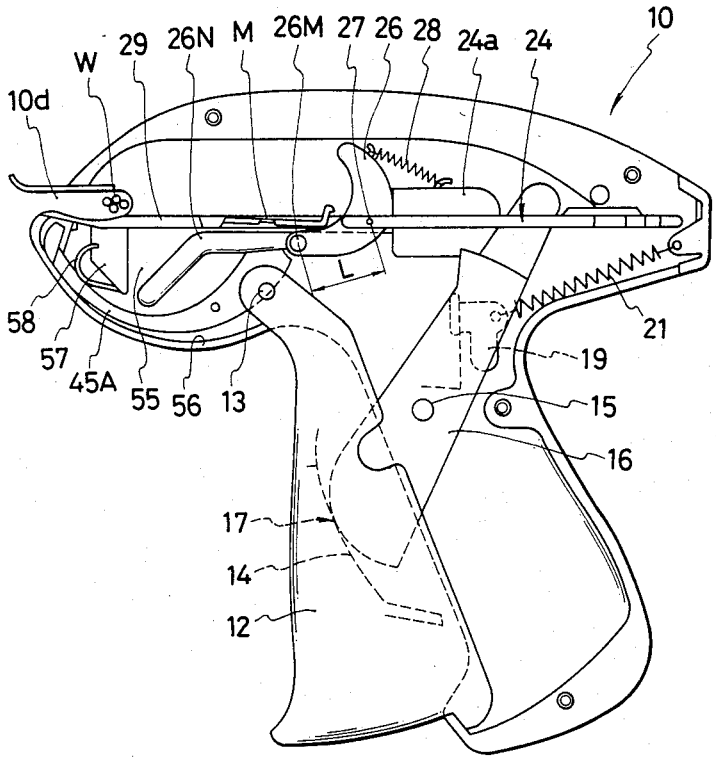
FIGS. 9 and 10 in combination represent a second embodiment and respectively show a sectional view of essential parts of the apparatus of this embodiment, similar to FIGS. 5 and 7, respectively.
Figure 10:
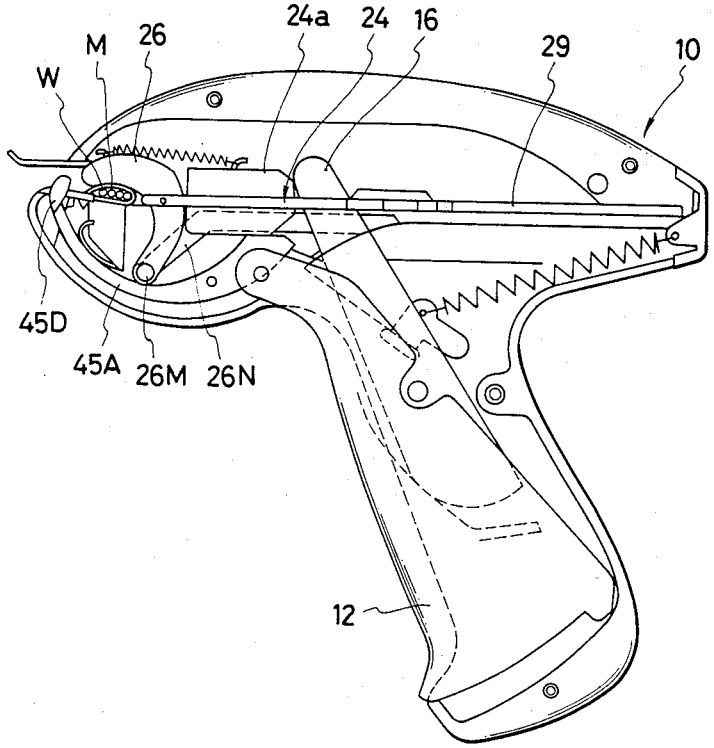

FIGS. 9 and 10 in combination show a second preferred embodiment of the invention.

Whereas the first embodiment basically represented by the illustration in FIG. 5 is in part characterized in that the folding lever 26 is formed with the lower fork portion 26*a*, which is engaged with the pin 26*b* to effect pivotal inclination of the lever 26, the second embodiment to be described is characterized in that it makes use of a cam mechanism for the pivotal motion of the lever 26.

With reference to FIG. 9, it will be seen that the folding lever 26 is provided with a cam pin 26M at its lower end portion, which pin is received and guided in a cam groove 26N provided to the side of the machine body 10, in a shape comprising a first substantially horizontal groove portion and a second forwardly downwardly inclined portion. Further, in the open space indicated at 55 in a nose end portion of the machine body 10, there is formed a curved guide surface 56, along which a stopper 45A is guided. To a support member 57 projected in the open space 55, a spring 58 is attached, which functions to maintain the stopper 45A in its original position (at which it does not stop motion of the element).

According to the second embodiment under consideration, when the pusher member 24 is put for a forward motion, the cam pin 26M is moved in the groove 26N. As the cam pin 26M moves in the second groove portion having a forwardly lowering inclination, the folding lever 26 movable with the pusher member 24 is caused to change its position from the one shown in FIG. 9 to the one shown in FIG. 10, turning a second half portion of the element over objects to be bundled.

An essential characteristic of this second embodiment of the invention resides in that since it is guided along the cam groove 26N, the motion of the folding lever 26 can be highly accurate and precise. Also, as can be seen from FIG. 9, according to this embodiment it is feasible to obtain a relatively great value for the length L of the distance between the cam pin 26M and the pin 27 for supporting the folding lever 26 onto the pusher member 24, so that effectively reduced can be the required force for bending or folding the element through the motion caused of the pusher member 24. Therefore, it is possible to prevent from occurring or suppress otherwise likely accidents such as an operation failure or a damage of the machine. In addition, the machine can effectively handle elements of a relatively large size.

FIGS. 11 to 14 represents a third embodiment of the invention, of which the arrangement is such that the movable stopper 45 in the above described first and second embodiments is now dispensed with. That is to say, whereas the stopper 45 is operable to once stop the element M at the bending operation part at a nose end portion of the machine body 10 for bending and fastening the element M, this structuring is simplfied in the present third embodiment.

Figure 11:
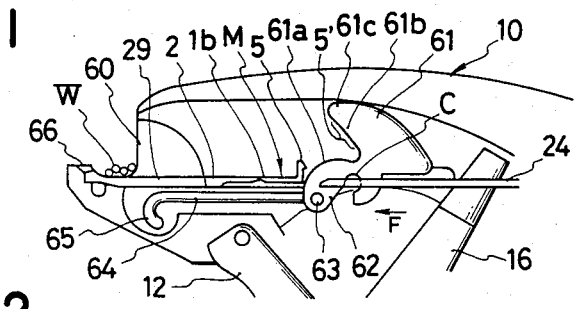
FIGS. 11 through 14 are respectively a partial side elevational view of a banding machine according to a third embodiment of the invention and in combination show a first to a last operation conditions of the machine.

FIG. 11 shows, with the left member 10*a* of the machine body 10 removed away, the inner structure of a banding machine, and with this machine, a nose end portion thereof is notched to form a receiving portion 60 for cables or the like W, which should be of a profile facilitating the placement of objects to be banded therein.

Immediately in front of the pusher member 24 driven to forward and backward reciprocation by the lever 16, there is disposed a pusher cam 61 adapted to rock toward up and down with a shaft C as the center of the rocking motion. The cam 61 has an extended part 62 provided with a pin 63 thereon, which is fitted in and guided in and along a guide groove 64 provided lower to the guide groove 29 formed in the inner wall of the machine body 10.

At a front end portion, the guide groove 64 is curved toward below to form a curved groove portion 65, which guides the pin 63 downwardly to cause the pusher cam 61 to take a forwardly downwardly rocked position and also to stop the pin 63 at the lower end thereof. In the condition in which the pin 63 is stopped at the lower end of the curved groove portion 65 as above, the pusher member 24 is further moved toward the nose of machine body 10, whereby the pusher cam 61 can be further rotated in the counterclockwise direction.

As shown in FIG. 11, the pusher cam 61 has a guide face 61*a* for raising the head 5 formed with the projection 6 of the element M to bring it to a raised position as shown at 5′ and another guide face 61*b* for bending or folding over the thicker part 1*b* at the side of the head 5 of the element M to the side of the ring part 2.

Figure 14:
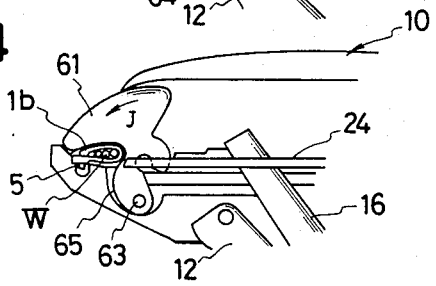
Figure 15:
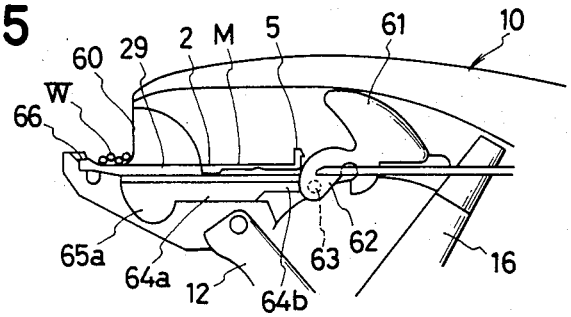
FIGS. 15 to 18 are partial side elevational views similar to FIGS. 11 to 14 and show operation conditions with a banding machine according to a fourth embodiment of the invention.
Figure 16:
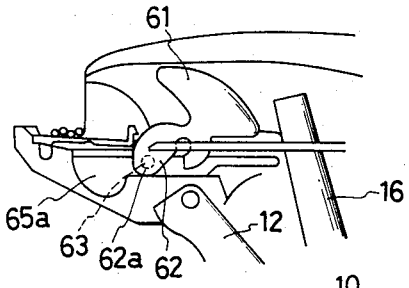
Figure 17:
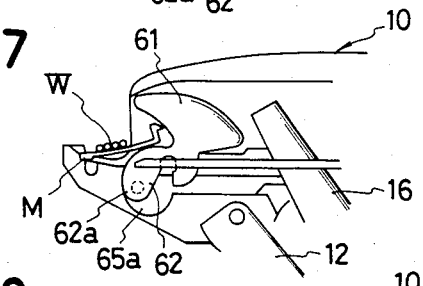
Figure 18:
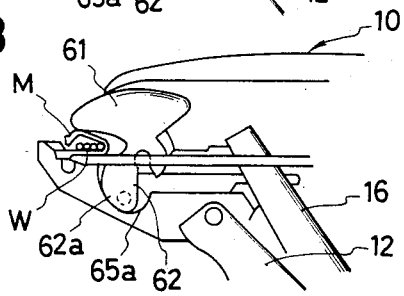

In front of the guide groove 29, a pair of stoppers 66 are integrally formed with the machine body 10 for holding in position the ring part 2 of the element M. Whereas the stoppers 66 are projected from the sides of the guide groove 29 so as to hold the ring part 2 in position as above and once stop the motion of the element M, and further to prevent the element from accidentally coming out of the machine, they are notched at their such portions which are in the way of a tip end 61*c* of the pusher cam 61, which at a final stage of the banding operation is moved to the position as shown in FIG. 14. It will be readily understood that depending on particular configurations of the tip end 61*c* and the stoppers 66, it may be unnecessary to notch the stoppers 66 as above.

The accompanying drawings include FIGS. 15 to 18, which in combination represent a fourth embodiment of the invention, in which the guide groove indicated at 64*a* has an expanded portion 65*a* in place of the curved groove portion 65 of FIGS. 11 to 14.

A characteristic of this fourth embodiment resides in that the guide groove 64*a* is, at its beginning end, so narrow as virtually only to allow the pin 63 to run therein, while it is broadened in its intermediate portion to allow to run therein both of the pin 63 and a lower end portion 62*a* of the extended portion 62 of the pusher cam 61, and in its ending length portion continuing from the intermediate portion, is further broadened to the form of the expanded groove portion 65*a* so as to therein guide the lower end portion 62*a*. According to the above structure in which the expanded groove portion 65*a* is provided for guiding extended portion 62*a* itself therein, it advantageously is feasible to keep the pin 63 free from a force application at a final stage of the banding operation, so that a greater force than otherwise can be applied to the pusher cam 61.

FIGS. 15 to 18 are taken corresponding to FIGS. 11 to 14, respectively, and the operational features of the banding machine of the fourth embodiment may be readily perceived if these FIGS. 11 to 14 for one thing and FIGS. 15 to 18 for the other are put for a comparative study. Thus, a description of the operational features of the banding machine according to the invention will be entered in the following in connection only with the third embodiment illustrated in FIGS. 11 to 14:

(A) Loading of Element Assembly:

FIG. 11 shows the operation condition corresponding to the previously considered one with reference to FIG. 8 (B), that is, the condition in which a strap-type banding element M is about to be fed toward the nose end of the machine. The element M is located at a rear end portion of the guide groove 29 and its head 5 is contacted by the guide face 61*a* of the pusher cam 61.

Figure 12:
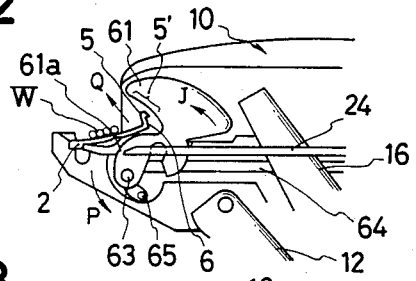

(B) Feed-In of Elements:

In the condition of FIG. 11, the operation lever or trigger 12 may be gripped in to drive the pusher member 24 and the pusher cam 61 in the direction of the arrow F. By the pusher cam 61, the element M is fed into a front or nose end point of the machine body 10 as shown in FIG. 12, and it then becomes immovable as a result of its ring part 2 being held between stoppers 66 provided at the sides in a front end portion of the guide groove 29. While the movement of the element M is stopped as above, the pusher cam 61 is kept moving forwardly and the pin 63 on the pusher cam 61 keeps moving in the curved groove portion 65 in the direction shown by an arrow P until it reaches the ending point of its motion. The pusher member 24 is then advanced further in the forward direction or the direction of the arrow F, whereby the pusher cam 61 now undergoes a rotation in the counterclockwise direction shown by an arrow J, and in accordance with this, the head 5 of the element M is raised by the guide face 61*a* as shown by an arrow Q. The raising of the head 5 as above is for letting the element M take the position indicated at 5' in FIG. 11.

As can be seen from FIG. 12, a group of linear objects such as cables, cords, wires and the like to be banded, W, are located on the thicker part 1*b* at the side of the ring part 2 of the element M, and the element receiving portion 60 of the machine body 10 is shaped so that in the vicinity of the reduced thickness part 1*a* at which the element M is double-folded, objects to be banded together W are not permitted to undergo dislocation toward the pusher cam 61.

Figure 13:
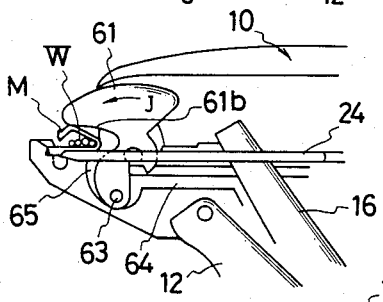

(C) Folding or Bending Operation:

As before stated, the pin 63 on the pusher cam 61 is stopped at the ending point of its motion in the curved groove portion 65, so that as the pusher cam 61 is then put for a further rotation, the element M becomes further raised along the guide face 61*a* toward the guide face 61*b* and bent or folded by the latter guide face 61*b* to hold objects to be banded W between the two thicker parts 1*b* and 1*b* as shown in FIG. 13.

(D) Banding Operation:

As shown in FIG. 14, as the pusher member 24 is further advanced the pusher cam 61 undergoes rotation in the direction of the arrow J to press by its guide face 61*b* the thicker part 1*b* at the side of the head 5 of the element M, and as a result of this, the projection 6 on the head 5 is forced into the aperture 3 of the ring part 2. At a final stage of this banding operation, the hook part or fluke 6*a* is lockably engaged with the edge wall portion 7 in the aperture 3.

With regard to matters to do with designing, the pusher cam 61 comes under a particularly important member or part in the above considered third embodiment of the invention. While this cam 61 is so designed along its front edge as to comprise continuous guide face 61*a* and guide face 61*b*, by way of suitably shaping the guide face 61*a* in particular it can be realized that the element M is raised with a relatively small force toward the other guide face 61*b* and is similarly bent by the guide face 61*b*.

Further in the third embodiment, the stoppers 66 for once stopping or holding in position the element M at a front or nose end portion of the machine body comprise stationary members, so that the structure of the banding machine is relatively simple.

As stated above, the cable banding machine according to the present invention is characterized by the structure and arrangement such that when the operation lever 12 is operated, banding elements M of the loaded element assembly M' can be individually severed one at a time, successively fed into the guide groove 29, delivered to the prescribed operation position for banding in accordance with advancing movement of the pusher member 24 caused through operation of the lever 12, and bent by the bending lever 26 or the pusher cam 61 disposed in front of the pusher member 24 adapted to rock or pivot to a double-folded position to automatically accomplish the banding operation.

Consequently, with the banding machine according to the invention, simply by triggering the operation lever 12, the above various movements of machine members can take place to carry out banding operation with strap-type banding elements, therefore banding operation is now performable with a single hand simply through a "one-action" operation as it were.

I claim:

1. A cable banding machine of the type with which a machine body broadly resembling a pistol receives supply of strap-type banding elements individually comprising a strap body having interlockable male and female members at one and the other ends thereof respectively and, when an operation lever provided to a grip handle is triggered, the banding elements are fed one at a time toward a nose end portion of the machine body and applied about a plurality of cables or the like to be banded altogether and received on a front end portion of the machine body, and then fastened with the male and female members interlocked to accomplish banding, the machine comprising a pusher member driven through triggering of the operation lever to move in a guide path in the machine body from a rear end portion to a nose end portion of the machine body while pushing a banding element, a stopper for fixing an end portion of the banding element at a front end portion in the guide path during a banding operation, and a pusher lever pivotally supported at a front end portion of the pusher member and having a bending face along its front edge by which, after the movement of the banding element is stopped by the stopper, the male and the female members of the banding element are interlocked by the pivoting movement of the pusher lever.

2. A machine as claimed in claim 1, wherein said stopper is provided below a front end portion of the guide path and adapted to come up into the path to stop the banding element from moving during the banding operation.

3. A machine as claimed in claim 1, wherein said stopper is stationary and provided at a front end portion of the guide path.

4. A machine as claimed in claim 1, wherein said stopper is provided on each side at a front end portion of the guide path.

5. A machine as claimed in claim 1, wherein said pusher lever is adapted to forwardly downwardly rock in engagement with a pin fixed to the machine body.

6. A machine as claimed in claim 1, wherein said pusher lever is guided along a cam groove to forwardly downwardly rock.

7. A machine as claimed in claim 6, wherein said pusher lever comprises a pusher cam having a pin provided thereon, said pin being guided in a guide path formed in the machine body to cause the pusher cam to forwardly downwardly rock.

8. A machine as claimed in claim 1, wherein said machine body is adapted to receive supply of banding elements from one side thereof and move each banding element supplied to a nose end portion thereof to operate banding of objects received in a front end portion thereof.

9. A machine as claimed in claim 1, wherein the arrangement is such that a banding operation is accomplished through operation of a single lever.

* * * * *